US010519012B1

(12) United States Patent
Hare

(10) Patent No.: US 10,519,012 B1
(45) Date of Patent: Dec. 31, 2019

(54) BILLET FAIRLEAD WITH RECESSED TOWING END STORAGE

(71) Applicant: Addictive Desert Designs, LLC, Mesa, AZ (US)

(72) Inventor: Jared A. Hare, Mesa, AZ (US)

(73) Assignee: ADDICTIVE DESERT DESIGNS, LLC, Mesa, AZ (US)

( * ) Notice: Subject to any disclaimer, the term of this patent is extended or adjusted under 35 U.S.C. 154(b) by 0 days.

(21) Appl. No.: 16/126,903

(22) Filed: Sep. 10, 2018

(51) Int. Cl.
*B66D 1/36* (2006.01)

(52) U.S. Cl.
CPC ..... *B66D 1/36* (2013.01)

(58) Field of Classification Search
CPC . B60D 1/18; B60D 1/187; B60D 1/48; B60D 1/54; B60D 1/56; B60D 1/565; B60D 1/58; B60D 1/583; B60D 1/60; B60D 1/605; B66D 1/36; B60P 3/125; B60R 19/48; B63B 21/58
USPC ..... 294/82.1, 215; 410/103, 107, 111–114; 280/480.1
See application file for complete search history.

(56) References Cited

U.S. PATENT DOCUMENTS

| | | | | |
|---|---|---|---|---|
| 2,856,865 | A * | 10/1958 | Reynolds | B61D 45/001 410/111 |
| 6,138,975 | A * | 10/2000 | McDaid | B61D 45/001 248/499 |
| 6,793,449 | B1 * | 9/2004 | Simpson | B60P 7/0807 410/100 |
| 7,731,218 | B2 * | 6/2010 | McGinnis | B60D 1/185 242/379.2 |
| D731,293 | S * | 6/2015 | Fretz | D8/356 |
| 9,604,826 | B2 * | 3/2017 | Fretz | B66D 1/02 |
| 2017/0320710 | A1 * | 11/2017 | Fretz | B66D 1/36 |
| 2017/0321851 | A1 * | 11/2017 | Fretz | B63B 21/14 |
| 2019/0127190 | A1 * | 5/2019 | Fretz | B66D 1/36 |

* cited by examiner

*Primary Examiner* — Dean J Kramer

(57) ABSTRACT

A billet fairlead with a front surface, a recess, with a recess perimeter shape and a fairlead extending through the front surface. The billet fairlead is paired with a towing end with a towing end perimeter shape that is substantially the same as the recess perimeter shape such that the towing end is removable and receivable into the recess for storage in one orientation only.

16 Claims, 5 Drawing Sheets

BILLET FAIRLEAD WITH RECESSED TOWING END STORAGE

FIELD OF THE INVENTION

The present invention relates to vehicle accessories and in particular to winches, fairleads, and related accessories.

SUMMARY OF THE INVENTION

The accessory mount comprises a device, kit, apparatus, and method for improving vehicles by supplementing a vehicle with an aftermarket accessory to facilitate use of a winch with a vehicle.

Aspects of the invention include embodiments wherein a billet fairlead is constructed to have a front surface and a fairlead extending through the front surface, a recess, and a towing end that is removable and receivable into the recess and wherein the towing end is connectable to a towing line that is extendable and retractable through the fairlead.

Aspects also include implementations wherein the recess is dimensioned to receive the towing end in only one orientation. For example, the towing end may have a perimeter shape that is the same as at least a portion of the recess perimeter shape. Moreover, the front surface may have a transition between the front surface and the recess forward facing surface that tapers and the towing end may have a matching tapered surface to make substantial contact against the transition between the front surface and the recess forward facing surface.

Numerous other advantages and features of the present invention will become readily apparent from the following detailed description of the invention and the embodiments thereof, from the claims and from the accompanying drawings.

Figure 1:
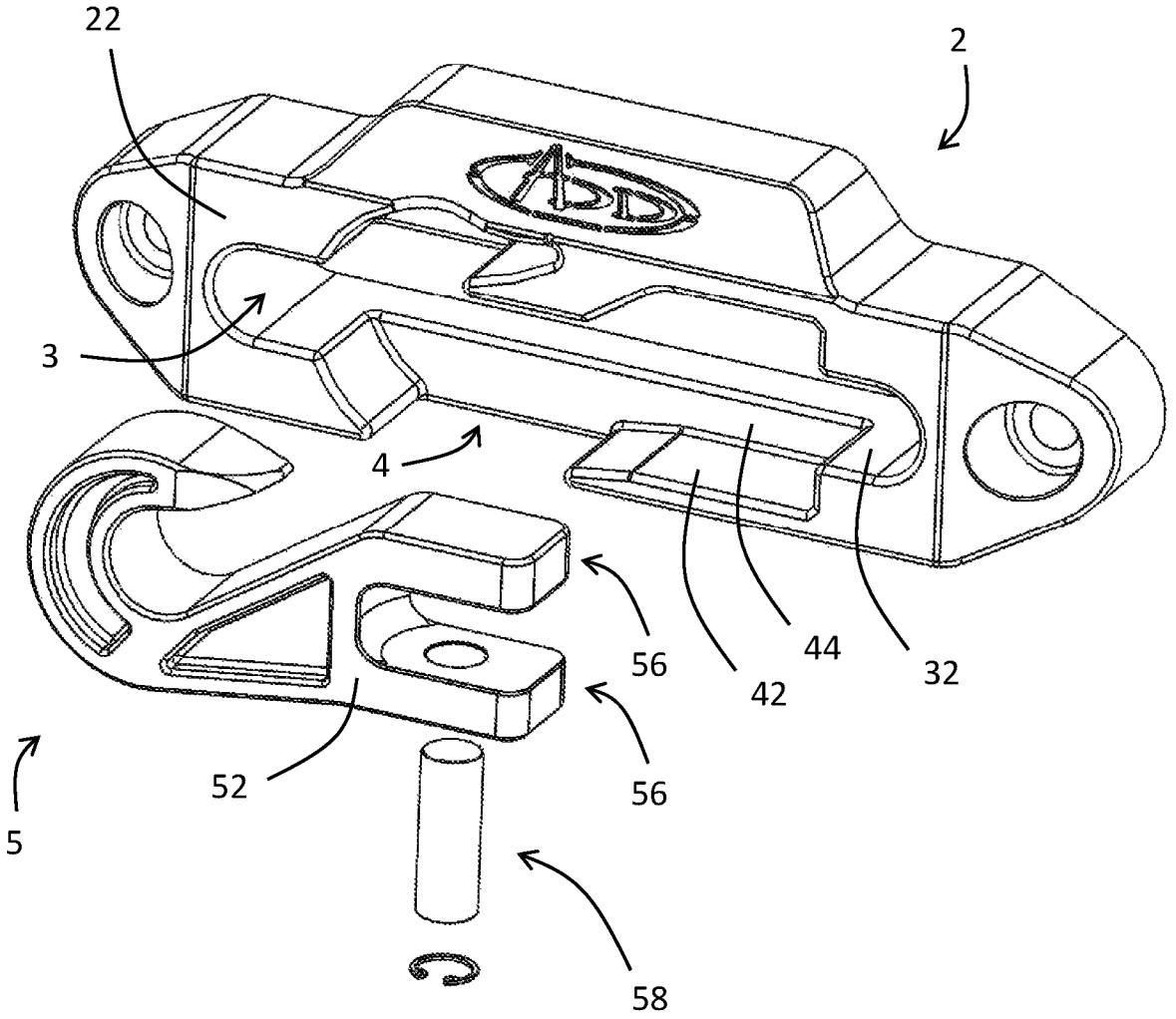
FIG. 1 illustrates a perspective view of an embodiment implementing features described herein wherein the towing end is a towing hook 5 and the recess 4 in the billet fairlead body 2 has a shape to receive the towing hook 5 in one orientation.
Figure 2A:
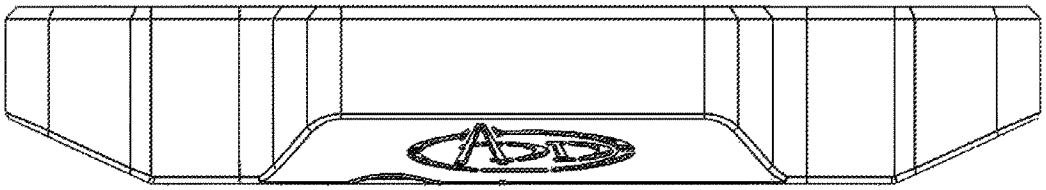
FIGS. 2A-2E illustrate top, left side, front, right, and bottom views, respectively, of a first embodiment wherein the front surface 52 of the towing hook 5 is flush with the body 2 front surface 22 if the towing hook 5 is received in the recess 4 in one orientation.
Figure 2C:
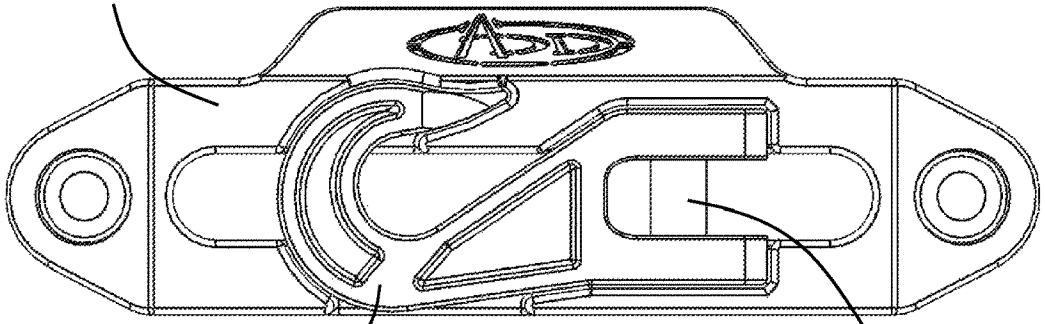
Figure 2E:
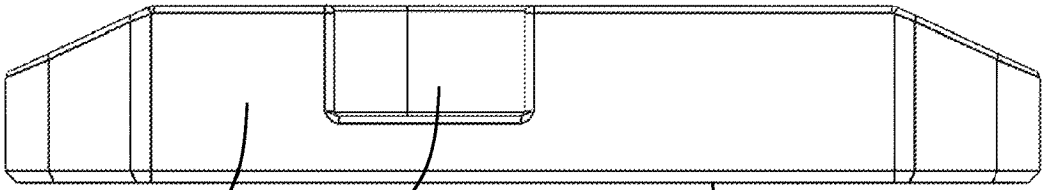
Figure 2B:
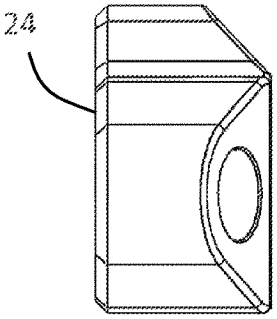
Figure 2D:
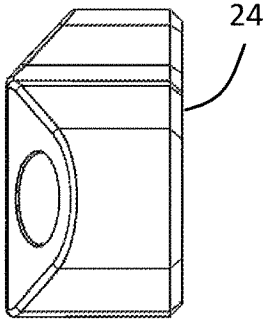
Figure 3D:
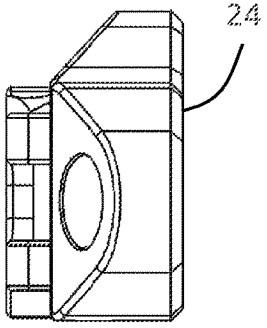
FIGS. 3A-3E illustrate top, left side, front, right, and bottom views, respectively, of a second embodiment wherein the front surface 52 of the towing hook 5 is not flush with but positioned forward of the body 2 front surface 22 if the towing hook 5 is received in the recess 4 in the one orientation.
Figure 3A:
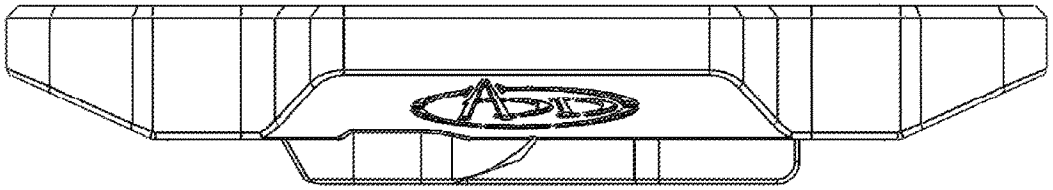
Figure 3C:
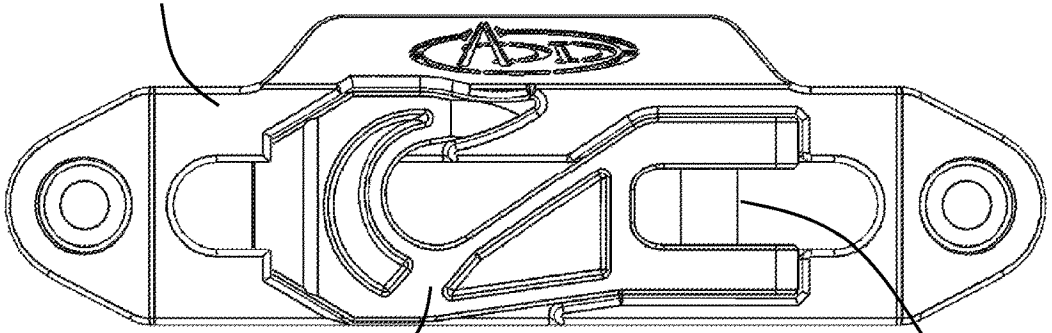
Figure 3E:
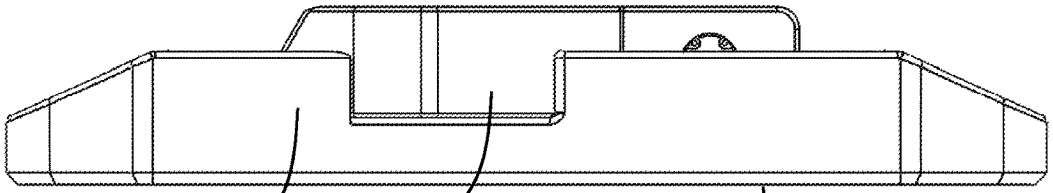
Figure 3B:
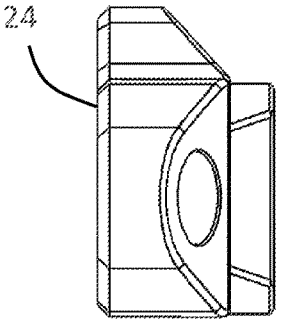

The objects, features and advantages of the present invention will be more readily appreciated upon reference to the following disclosure when considered in conjunction with the accompanying drawings, wherein reference numerals are used to identify the components in the various views.

DESCRIPTION OF PREFERRED EMBODIMENTS

The figures illustrate an embodiment of a billet fairlead according to the description and claims that follow. The billet fairlead may be generally described as construction of metal that is preferably, but not necessarily, formed by casting or milling a billet to have the structural features described and illustrated herein. A generally preferred billet fairlead according to the specification and illustrations may comprise a cast, mass, or body 2 having a front surface 22 and a fairlead 3 extending through the front surface 22 to the rear surface 24. A cavity or recess 4 may be constructed or positioned within the front surface 22 for receipt of a towing implement end or towing end (e.g. such as a towing eye or towing hook 5) that is attachable to a towing line or cable through the fairlead 3 to be extractable and receivably retractable into the recess 4 for secured storage. In an exemplary implementation, the preferred billet fairlead may be attached to a vehicle bumper with a first end of the towing line or cable connected to a winch and spool located behind the vehicle bumper and the towing implement end, such as a towing hook 5 is connected to the other end of the towing line or cable that is threaded through the fairlead 3. When the towing hook 5 is not being used it may be stored securely in the recess 4. Contrarily, during use, the winch and spool may be operated in a first direction to extract towing line from the winch spool and provide sufficient slack in the towing line to unsecure the towing hook 5 from the recess 4.

The billet fairlead described herein is adaptable and may to be affixed to any of a variety of vehicle bumpers and may be configured or constructed to match the curve, shape, or design of the vehicle bumper. As an example, the billet fairlead construction described can be configured or constructed to match and be attached to planer, curved, bowed, or alternately shaped bumpers to augment the utility and/or aesthetics of the vehicle bumper. The billet fairlead may be embodied alone or by the further attachment of aftermarket accessories such as, but not limited to, lighting, speakers, or cameras. Alternate configurations of the billet fairlead are constructed for alternate vehicle bumper designs and each construction is achievable with the teachings and description herein or with modest modifications thereof.

Preferred embodiments of the billet fairlead may include additional features described herein and with reference to the illustrations. As an example, and as illustrated in FIG. 1, the recess 4 may have a recess perimeter that is dimensioned to receive the towing end in only one orientation. As an example, the towing end may have a towing end perimeter shape and the recess perimeter has a recess perimeter shape of which at least a portion of the shape is substantially the same shape as the towing end perimeter shape if the towing end is oriented in the one orientation. FIG. 1 illustrates an example wherein the towing end may comprise a towing hook 5 and at least a portion of the recess perimeter shape is a towing hook perimeter shape. In yet another example, the towing end may be a towing eye and at least a portion of the recess perimeter shape is a towing eye perimeter shape.

Figure 4A:
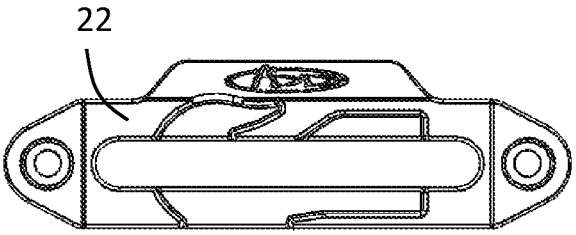
FIGS. 4A-4C illustrate front, right side, and right side cutaway views of the first embodiment wherein the recess perimeter shape resembles a towing hook 5.
Figure 4B:
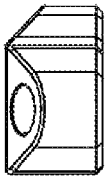
Figure 4C:
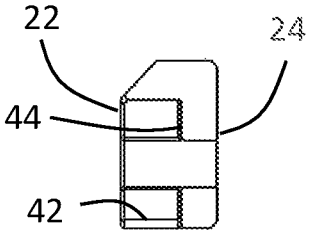
Figure 5A:
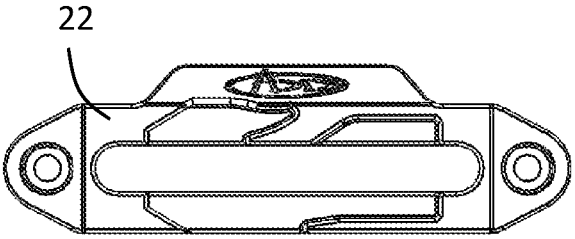
FIGS. 5A-5D illustrate right side and right side cutaway views of a second embodiment wherein the recess perimeter shape resembles a towing hook 5 and at least a portion or segment of the recess side surface 42 tapers between the forward facing body front surface 22 and the recess forward facing surface 44.
Figure 5B:
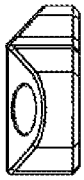
Figure 5C:
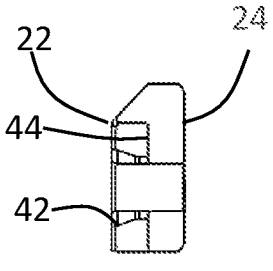
Figure 5D:
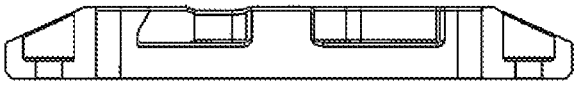

The recess 4 is preferably located on the front surface 22 and positioned on or at the opening of the fairlead 3 such that body 2 comprises at least two substantially parallel forward facing surfaces—the body front surface 22 and a recess forward facing surface 44. In such embodiments, the body front surface 22 and the recess side surface 42 transition at an angle that exceeds 30 degrees and is preferably between about 60 degrees or 90 degrees and wherein the recess forward facing surface 44 and the forward facing body front surface 22 are substantially parallel. As one example, a first embodiment may have an intersection or transition of the forward facing body front surface 22 and the recess side surface 42 at an angle of about 90 degrees as illustrated in the side view cutaway of FIG. 4C, and a second embodiment may taper at the intersection or transition of the forward facing body front surface 22 at an angle of about 60 degrees as illustrated in the side view cutaway of FIG. 5C. In such embodiments, and as discussed further below, the towing end will be similarly tapered to match the taper at the intersection or transition of the forward facing body front surface 22 to the recess forward facing surface 44.

Further, it is preferred that the towing end has a towing end rear surface that mirrors and that substantially contacts against the recess forward facing surface 44 if the towing end is received into the recess 4. For example, and as illustrated in FIG. 1, the towing hook 5 may have a shape that matches or mirrors the recess perimeter shape such that at least one, but preferably at least two, of the towing hook surfaces 52 makes substantial (and in preferred embodiments, flush) contact against at least one, but preferably both of the recess side surface 42 and the recess forward facing surface 44. Moreover, in the first embodiment illustrated in FIGS. 2A-2E, the towing end is received substantially entirely into the recess 4 in the at least one orientation such that the forward facing towing hook surface 52 is flush with the front surface 22. See FIGS. 2A-2E. In an alternate preferred embodiment in FIGS. 3A-3E, the towing end is received less than entirely into the recess 4 such that the towing end front surface 52 projects beyond front of the billet fairlead or body 2 front surface 22.

Figure 6A:
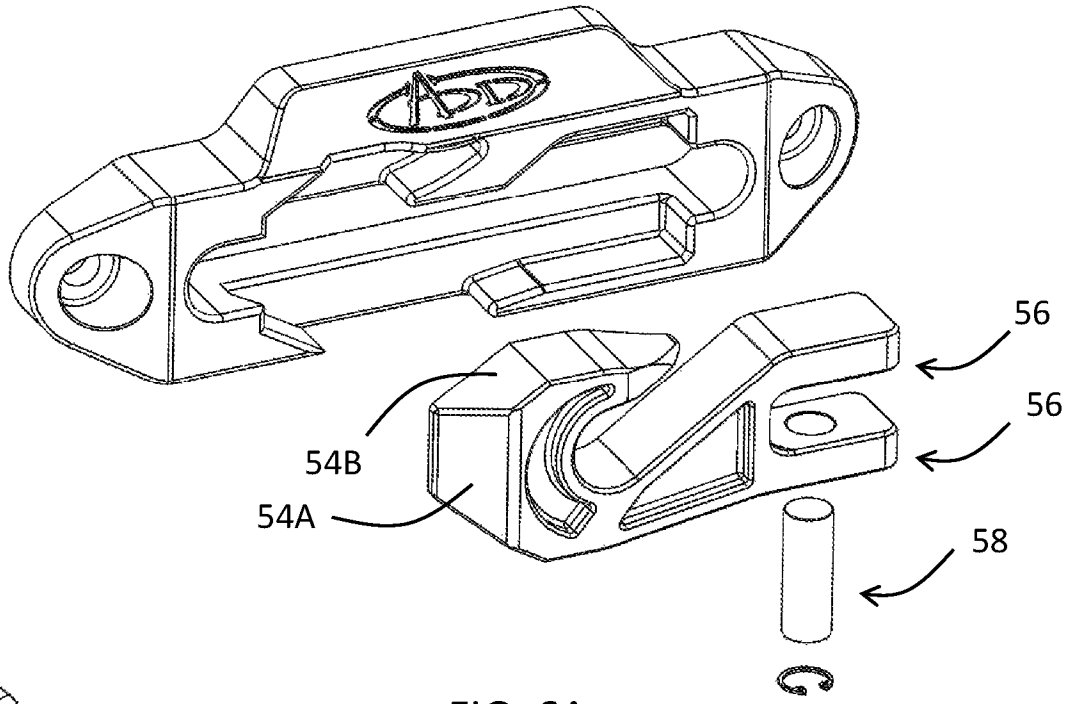
FIGS. 6A-6C illustrates a perspective view of the embodiment illustrated in FIGS. 5A-5D wherein the towing hook 5 has a tapered portion 54B that matches the portion or segment of the recess side surface 42 taper between the forward facing body front surface 22 and the recess forward facing surface 44.
Figure 6C:
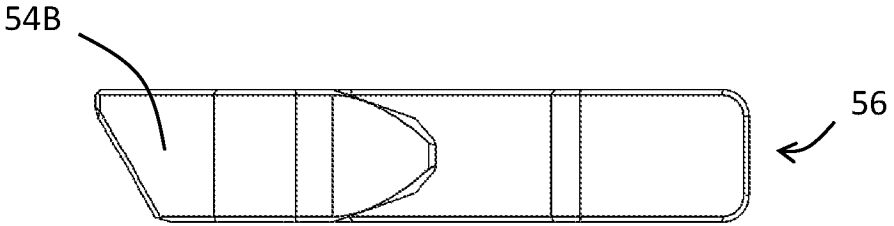
Figure 6B:
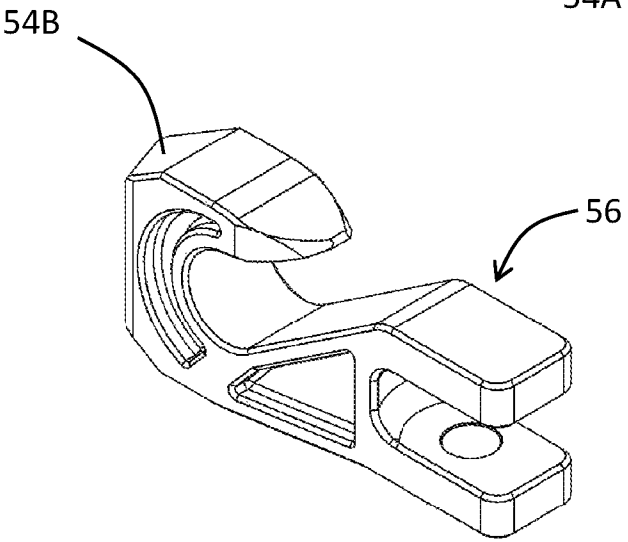

A preferred recess perimeter shape comprises a towing hook 5 shape or a partial or portions of a towing hook 5 shape oriented lengthwise relative to the longest dimension of the front surface 22 and wherein a first portion of the towing hook 5 shape and a second portion of the towing hook 5 shape are positioned on either side of the fairlead 3 on the front surface 22, respectively. See FIGS. 2C and 3C. Additionally, the towing hook 5 may have a U-shaped end with first and second segments 56 with a removable pin 58 that traverses a gap between the first and second segments 56 and having first and second pin 58 ends that are received into the first and second segments 56, respectively. Further, whereas the first and second segments 56 may be received on top and bottom sides of the recess perimeter shape, and preferably, substantially within the perimeter of the forward facing body front surface 22, the hook-shaped end of the towing hook 5 may have a portion of the towing hook side surface 54 that is exposed through the body side surface 26 to facilitate easy grasping and removal of the towing hook 5. See FIGS. 2E and 3E. Moreover, it is preferred that towing-end perimeter shapes match corresponding recess perimeter shapes so that substantial contact is made between the side and/or rear towing hook surface 54. Accordingly, if the embodiment tapers at the intersection or transition of the forward facing body front surface 22 and the recess side surface 42, the towing end may similarly taper as in an exemplary embodiment that is illustrated in FIGS. 6A-6C, wherein a towing hook 5 may have at least one towing hook side surface (e.g. 54A and 54B) that matches the taper of the recess side surface 42.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

The invention claimed is:

1. A billet fairlead with a towing end, comprising:

a front surface wherein the fairlead extends through the front surface;

the towing end has a towing end perimeter shape;

a recess comprising a recess perimeter shape that is substantially the same as the towing end perimeter shape and dimensioned to receive the towing end perimeter shape into the recess in one orientation only and the front surface includes an intersection between the front surface and the recess perimeter shape, the intersection substantially comprising a taper between 30 and 110 degrees.

2. The billet fairlead, in claim 1 wherein, the taper is about 60 degrees.

3. The billet fairlead, in claim 1 wherein, the towing end has a towing end side surface with a taper that matches the taper of the intersection between the front surface and the recess perimeter shape.

4. The billet fairlead, in claim 3 wherein, the fairlead has a fairlead side surface and the recess includes a recess side surface that intersects the fairlead side surface.

5. The billet fairlead, in claim 3 wherein, the recess has a recess forward facing surface that is substantially parallel to the front surface and the towing end has a towing end rearward facing surface that makes contact with the recess forward facing surface.

6. The billet fairlead, in claim 1 wherein, the towing end has a towing end forward facing surface that is substantially parallel to and flush with, but does not contact, the front surface.

7. The billet fairlead, in claim 1 wherein, the towing end has a towing end forward facing surface that is substantially parallel to and does not contact the front surface.

8. A towing line fairlead, comprising:

a billet having a front surface with a front surface perimeter and a fairlead extending through the front surface;

a recess with a recess perimeter shape and a recess side surface, the recess substantially within the front surface perimeter, and the front surface includes an intersection between the front surface and the recess perimeter shape, the intersection substantially comprising a taper between 60 and 90 degrees; and a towing end with a towing end side surface and a towing end perimeter shape, the towing end perimeter shape substantially the same as the recess perimeter shape and the towing end received into the recess perimeter shape in one orientation only and towing end side surface contacts the recess side surface;

wherein the towing end is connectable to a towing line that is extendable through the fairlead to enable removal of the towing end from the recess and retractable through the fairlead to secure the towing end within the recess.

9. The towing line fairlead in claim 8 wherein, the towing end is a towing hook and the recess perimeter is dimensioned to receive the towing hook in only one orientation.

10. The towing line fairlead in claim 9 wherein, at least a portion of the recess perimeter shape comprises a towing hook shape oriented lengthwise relative to the longest dimension of the front surface and wherein a first portion of the towing hook shape and a second portion of the towing hook shape are positioned on either side of the fairlead, respectively.

11. The billet fairlead, in claim 8 wherein, the towing end has a rearward facing surface that is rearward of the front surface and a forward facing surface that does not make contact with the billet.

12. The billet fairlead, in claim 8 wherein, the taper is about 60 degrees.

13. The billet fairlead, in claim 8 wherein, the towing end has a towing end side surface with a taper that matches the taper of the intersection between the front surface and the recess perimeter shape.

14. The billet fairlead, in claim 8 wherein, the fairlead has a fairlead side surface and the recess includes a recess side surface that intersects the fairlead side surface.

15. The billet fairlead, in claim 8 wherein, the recess has a recess forward facing surface that is substantially parallel to the front surface and the towing end has a towing end rearward facing surface that makes contact with the recess forward facing surface.

16. The billet fairlead, in claim 15 wherein, the towing end has a towing end forward facing surface that is flush with the front surface.

* * * * *